United States Patent [19]

Forsyth

[11] Patent Number: 4,613,242

[45] Date of Patent: Sep. 23, 1986

[54] DOT MATRIX PRINT HEAD

[75] Inventor: John L. Forsyth, Greenfield, N.H.

[73] Assignee: Royden C. Sanders, Jr., Wilton, N.H.

[21] Appl. No.: 724,627

[22] Filed: Apr. 17, 1985

[51] Int. Cl.[4] ..... B41J 3/12

[52] U.S. Cl. ..... 400/124; 101/93.05

[58] Field of Search ..... 400/124; 101/93.05; 335/271, 274

[56] References Cited

U.S. PATENT DOCUMENTS

| | | | |
|---|---|---|---|
| 3,672,482 | 6/1972 | Brumbaugh | 400/124 |
| 3,770,092 | 11/1973 | Grim | 400/124 |
| 4,134,691 | 1/1979 | Matschke | 400/124 |
| 4,157,873 | 6/1979 | Ito | 400/124 |
| 4,197,021 | 4/1980 | Gomi et al. | 400/124 |
| 4,202,638 | 5/1980 | Stenudd | 400/124 |
| 4,204,778 | 5/1980 | Miyazawa et al. | 400/124 |
| 4,273,452 | 6/1981 | Honma | 400/124 |

*Primary Examiner*—Paul T. Sewell

*Attorney, Agent, or Firm*—Hayes, Davis & Soloway

[57] ABSTRACT

A dot matrix print head utilizing a print pin carrying spring beam mounted as a cantilever with an armature mounted thereon over a solenoid housing with a spring member overlying a portion of the beam to resist motion of the beam past its rest position on rebound following a printing stroke.

6 Claims, 3 Drawing Figures

DOT MATRIX PRINT HEAD

The present invention is directed to improvements in dot matrix print heads particularly in the type described in my copending applications Ser. No. 519,880, filed Aug. 2, 1983, and Ser. No. 544,397, filed Oct. 21, 1983. In these dot matrix print heads, individual solenoids drive individual print wires attached to very light weight spring beam members, each of which carries an armature which is attracted to a core of its solenoid. The outer end of this beam member, which supports the print wire, is cantilevered to a base at its other end. The end of the spring beam member that supports the print wire preferably is stiffened, the preferred stiffening comprising a rib which can be formed of the spring material itself, this rib being at right angles to the planar surface of the spring beam member. With this light weight construction, the only appreciable mass is the armature itself, and consequently it allows, with features as defined in the aforementioned applications, very fast print rates of the order of 3,000 printing strokes per minute.

The present invention is primarily directed to improving the performance (improved frequency response and increased dynamic print range). A secondary consideration is increased spring beam assembly life achieved by reducing the amplitude of the stress reversal cycle during printing and manufacturing ease. It also provides a system where no adjustment of this spring member is required during manufacture and an increase in the dynamic print range is achieved. This dynamic print range is defined as the furthest acceptable gap setting minus the closest gap setting. The system frequency response can also be increased, in the light of the above considerations, particularly by eliminating any possibility of harmonics which might be generated and which might interfere with proper repeat printing strokes in the higher frequency ranges.

There basically is no prior art directed specifically to the problems encountered in this invention although the following three patents are of interest in connection with this development: U.S. Pat. No. 4,202,638 to Stenudd; U.S. Pat. No. 4,204,778 to Miyazawa; and U.S. Pat. No. 4,273,452 to Honma.

The present invention involves an improvement in a print element of the type described in the above mentioned copending applications wherein a spring beam member carries an armature and print pin. In the present invention a second member overlies this first spring member in the area between the armature core and the cantilever attachment end. The second spring member is inoperative to bear on the first spring member during most of the print stroke while providing increased resistance to movement of the first spring member past the rest position in the direction of the return stroke of the print wire. The second spring member normally lies, in its unbiased state, in contact with the upper surface of the armature spring beam member while the armature spring beam member is in the rest position. As the first spring beam member moves away from the rest position to the print position it moves away from the second spring member. Therefore the mass of the second spring member is not involved in the print stroke. However, when the armature spring member moves back, on rebound, to the rest position it contacts the second spring member and, due to the kinetic energy remaining in the mass of the armature spring member it tends to move beyond the rest position, particularly due to the mass in the armature itself. As the armature spring member moves to and beyond the rest position it engages the second spring member and the spring constant of the second spring member is added to the spring constant of the armature spring member. Thus, the spring constant of the assembly is essentially that of the armature spring member during the print stroke but is the sum of the spring constants of both spring members as a portion of the first of the armature spring member bows beyond the rest position.

In order to more fully understand the present invention, reference should be made to the following descriptions of the accompanying drawings, given by way of example, in which.

Figure 1:
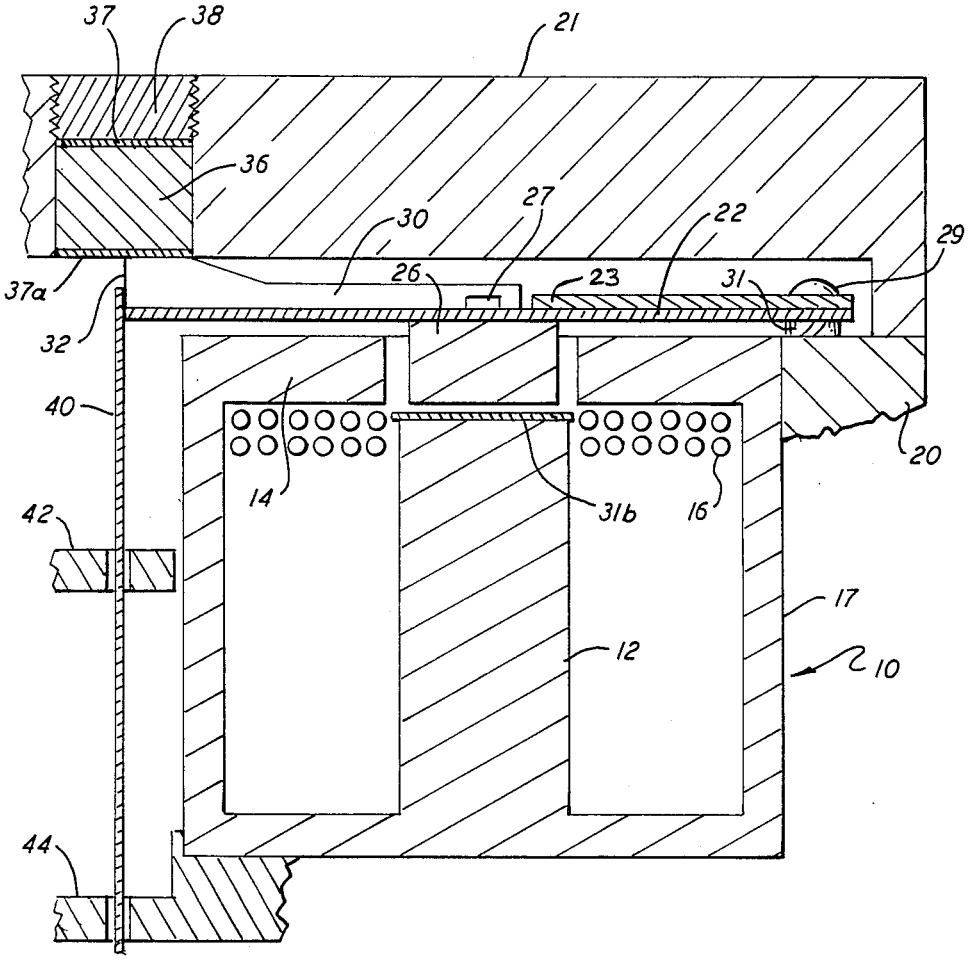
FIG. 1 is a diagramatic, schematic, sectional view through one print head assembly showing a solenoid print wire and related structures.

Referring now to FIG. 1, one individual solenoid is generally indicated at 10, having a central fixed core 12, a return path for the magnetic circuit 14 and 17 and a low impedance actuating coil 16 confined within an outer housing 17. A portion of the housing carrying all of the spring armature beam member is shown generally at 20 while the spring armature beam members for driving the print needles is shown at 22. The moveable armature indicated at 26 is attached to the spring armature beam 22 by rivet 27. The spring armature 22, in turn, is secured to the top of the magnet assembly by means of a fastener such as screw 29. A tapered shim 31 is positioned between the armature spring 22 and the top of housing 20. Another metallic shim **31*b*, preferably of stainless steel, overlies the end of stationary core 12** to provide an anti-residual magnetic shim and to reduce wear.

The L-shaped section 30 of the spring armature member 22 extends from adjacent the attachment point 27 for the moveable armature core 26 out to the end of the spring 22 to form a relatively rigid, but lightweight, section of armature spring for transmitting the downward motion of the armature 26 to the print needle 40. The remainder of the spring beam 22 is essentially planar to permit ready resilient flexure in the beam driving direction. The print needle is attached by a metallurgical bond to the end 32 of the L-shaped upstanding section 30 of the armature spring. In a preferred form this metallurgical bond is a relatively high temperature solder such as a silver solder. The section of the spring beam 22 between its effective pivot point and end 32 preferably has a mass of less than 0.3 grams including print pin and armature. An impact absorbing (damping) member 36 is carried by a cover 21 and comprises a cylinder of plastic such as polyurethane. Above the plastic cylinder is a sheet of plastic 37, formed of a material such as Polyester, Polytetraflouroethylene or the like, which forms a low friction surface with the adjustment screw 38. The screw 38 is used for adjusting the downward position of the cylinder 36, thus controlling the amount of compression on the spring beam 22. Alternatively, a layer of graphite may be provided between elements 36 and 38 to provide relatively easy rotation of the cylinder 36 around its axis.

In addition to the sheet 37 of plastic, between the member 36 and the screw 38, there is preferably provided a second sheet of thin stainless steel (or hard plastic) 37*a* on the bearing surface of member 36 which is adapted to contact the end 32 of the spring armature 22. This sheet of metal (or hard plastic) is for the purpose of minimizing wear of the end member 36.

In a preferred form the spring beam has a total needle driving stroke of between 1°–3° about its point of flexure (effective pivotal axis) and has a zero or small (e.g. 0–½ degree) preload.

As a result of the tilt (1°–5°) of the spring beam 22 due to shim 31 the lower surface of the movable armature core 26 is also tilted a like amount with respect to the upper surface of the stationary core 12. When the movable core 26 is attracted to and contacts the stationary core 12, their two adjacent surfaces become parallel, thus increasing the attractive force and efficiency of the solenoid.

Figure 2:
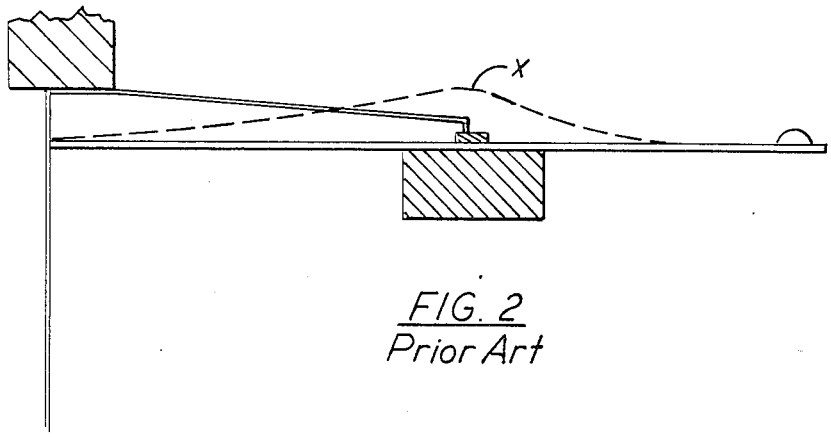
FIG. 2 Prior Art
FIG. 2 is a diagramatic sketch emphasizing the flexing motion of the armature spring beam of the assembly without the improvement of the present invention.

In the present invention, a second spring member 23 is positioned over the rear portion (i.e., the portion which has the cantilevered attachment) of the spring beam 22. In one preferred embodiment, this second spring is of the same material and thickness as the spring material forming the spring beam 22, extends from the cantilevered attachment to adjacent said armature (or even beyond) and is secured by means of the same fastener 29. As can be seen, this second spring member at rest lies flat on top of the spring beam 22 and is effectively inactive so long as the motion of the armature spring beam member is downward, (i.e. in the print direction). However, when the armature spring beam member rebounds from the print stroke to return to the rest position shown in the drawing, the outer end 32 strikes the damper 36 and tends to come to a rest. However, the kinetic energy remaining in the armature beam 22 tends to bow the spring armature into the dotted line position shown at X in FIG. 2. Since this provides a subsequent reactionary motion downward of the print pin during the subsequent resonance, it can, with the next print stroke cause a contact with the paper which is incorrectly timed, either being slightly too soon or too late. With the second spring member 23 in position, the maximum bending is greatly reduced.

Figure 3:
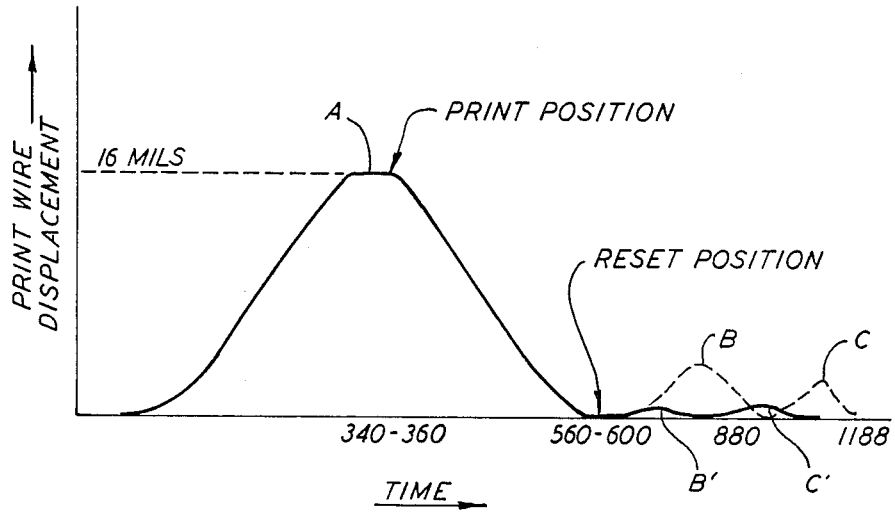
FIG. 3 is a plot of motion of print pin tip as a function of time, both with and without the present invention.

To understand this operation more fully, reference should be made to FIG. 3 which is an oscilloscope recording of the motion of the tip of the wire as a result of a printing stroke. In this FIG. 3 the wire tip moves a substantial distance to the point A which is the maximum print distance, then rapidly returns to the base line which is the rest position. However, due to the flexing and reflexing of the spring member (with no second spring member 23), there may be several more slight downward strokes as shown at B and C in dotted lines. With the addition of the second spring member, overlying the first member, the actual travel of the tip of the wire, as shown in solid lines, is very small with the height of stroke B′ and C′ being less than 3 mils. These small secondary strokes are not large enough to interfere with operation at any frequency in the range of operating frequencies contemplated.

The material of beam 22 and the second spring and these interacting surfaces are chosen to avoid corrosion problems and stiction between them. This may be achieved by suitable plating materials, sand or shot blasted surfaces, etc.

Although the second spring operates in accordance with this invention by modifying the spring rate and effective mass of the beam 22/second spring combination during rebound beyond rest position of beam 22, air damping is also achieved as air is driven from between these elements and as suction draws air between these elements as they come together and apart respectively. The damping action is relatively free from temperature changes in the operating temperature range of operation of the print head and no adjustment of the damping system is required.

In the above discussion, the rebound effect of the energy absorbing means 36 is ignored. This can be done since its time constant is enormously greater than the frequency of operation of the print needle and therefore it has no effect on the operation of the print needle.

I claim:

1. A dot matrix print head wherein individual print needles are selectively actuated by individual solenoids; each print needle being carried and driven by an armature carrying spring beam member having a relatively rigid outer section extending from a needle driving end, to which said needle is attached, at least to adjacent the armature, the remainder of said spring beam member being substantially planar to permit ready resilient flexure in the needle driving direction and having a substantially flat planar face, said spring beam member being attached as a cantilever to a support adjacent its end remote from the needle driving end, wherein a second flat planar face spring member overlies the first spring member, said face of the second spring member abutting said face of the first spring member in the area between the armature and the end remote from said needle substantially only when both said spring members are in a rest and in a rebound position, said second spring member being inoperative to bear on said first spring member during most of the print stroke from rest position to print position while providing increased resistance to movement of said first spring member on rebound past the rest position, and the needle driving end of said spring beam member contacting an impact absorbing member substantially only during rest and rebound.

2. A dot matrix print head wherein individual print needles are selectively actuated by individual solenoids, each print needle being carried by a beam having a mounting end and a print pin support end, means rigidly mounting said mounting end of said beam relative to said solenoid, an armature mounted to said beam to overlie an aperture in said solenoid, said beam having a resilient flat face portion disposed between said rigid mounting and said armature and being rigid from said armature to said print pin, wherein a flat face spring member overlies and abuts the flat face portion of the beam in the area between the armature and the mounting end substantially only when said beam and said spring member are in a rest and a rebound position, said spring member being inoperative to bear on said beam during most of the print stroke while providing increased resistance to movement of said beam on rebound past the rest position of said beam, and the print pin support end of said beam contacting an impact absorbing member substantially only during rest and rebound.

3. A dot matrix print head comprising a plurality of print elements, each said print element including a first spring beam member having a print pin secured to a first end, said first spring beam member being secured as a cantilever to a support end at a second end, a solenoid armature being supported between said two ends, a solenoid having a core and a hole in its magnetic circuit to receive said armature, attraction of said armature core to said solenoid causing a print stroke of said print pin from a rest position to a print position, a stiffening means of said first spring beam member extending from near said armature to near said print pin, the remainder of the spring beam member being arranged for resilient flexibility during the print stroke and return to the rest position, and having a flat face, a second flat face spring member overlying the flat face of the first spring beam member with said faces abutting in the area between the armature and the second end substantially only when both said spring members are in rest and rebound positions, said second spring member being inoperative to bear on said first beam member during most of the print stroke while providing increased resistance to movement of said first spring beam member past the rest position thereof on rebound from the print stroke, and the first end of said spring beam member contacting an impact absorbing member substantially only during rest and rebound.

4. The dot matrix print head of claim 3, wherein said second spring member normally lies in its unbiased state in contact with upper surface of said first spring member in its rest position;

whereby the spring constant of the assembly is essentially that of the first spring member during the print stroke but is the sum of the spring constants of both spring members as the portion of the first spring member between the armature and second end bows beyond the rest position on rebound.

5. The dot matrix print head of claim 3, wherein the second spring member is secured as a cantilever to said support and extends parallel to said first spring member when it is in rest position.

6. The dot matrix print head of claim 3, wherein the second spring member is secured to said first spring member to permit convex curvature of the first spring member during pin driving flexure thereof, but inhibits convex curvature of the first spring member when it attempts to bow past the rest position on rebound from the print stroke.

* * * * *